United States Patent [19]

Murayama et al.

[11] Patent Number: 4,560,330

[45] Date of Patent: Dec. 24, 1985

[54] SCROLL DEVICE WITH SUCTION CHAMBER PRESSURE RELIEF

[75] Inventors: Akira Murayama; Hiroaki Kuno; Naoshi Uchikawa; Takahiro Tamura; Takao Mizuno, all of Shimizu; Sumihisa Kotani, Ibaraki, all of Japan

[73] Assignee: Hitachi, Ltd., Tokyo, Japan

[21] Appl. No.: 662,691

[22] Filed: Oct. 19, 1984

[30] Foreign Application Priority Data

Oct. 21, 1983 [JP] Japan ..... 58-195974

[51] Int. Cl.[4] ..... F01C 1/04; F04B 49/08

[52] U.S. Cl. ..... 418/55; 417/410

[58] Field of Search ..... 418/55; 417/301, 307, 417/309, 310

[56] References Cited

U.S. PATENT DOCUMENTS

| | | | |
|---|---|---|---|
| 4,389,171 | 6/1983 | Eber et al. | 418/55 X |
| 4,431,380 | 2/1984 | Utter | 418/55 X |
| 4,431,388 | 2/1984 | Eber et al. | 418/55 |
| 4,456,435 | 6/1984 | Hiraga et al. | 417/310 X |

FOREIGN PATENT DOCUMENTS

| | | | |
|---|---|---|---|
| 57-76287 | 5/1982 | Japan | 418/55 |

*Primary Examiner*—John J. Vrablik
*Assistant Examiner*—Theodore Olds
*Attorney, Agent, or Firm*—Antonelli, Terry & Wands

[57] ABSTRACT

Disclosed is a scroll-type fluid machine which has an orbiting scroll member and a stationary scroll member each having an end plate and a spiral wrap protruding upright therefrom. The scroll members are assembled together such that their wraps mesh with each other to form therebetween closed chambers of volumes which are progressively decreased as the chambers are moved toward the centers of the scroll members as a result of an orbital movement of the orbiting scroll member with respect to the stationary scroll member. The machine is suitable for use as a refrigerant compressor in a refrigeration system. A fluid check valve is disposed in the refrigerant gas suction passage connected to the suction side of the machine, so as to prevent any reversing of the orbiting scroll member. A passage is formed to provide a communication between a suction chamber defined by the scroll members and another closed chamber. A relief valve is disposed in this communication passage so as to relief any abnormal high pressure from the suction chamber.

10 Claims, 14 Drawing Figures

SCROLL DEVICE WITH SUCTION CHAMBER PRESSURE RELIEF

BACKGROUND OF THE INVENTION

The present invention relates to a scroll type fluid machine and, more particularly, to a scroll type fluid wherein an abnormal pressure rise in the suction chamber which may occur when the machine is reversed is avoided.

A scroll type fluid machine has a compressor section and an electric motor section mounted in a hermetic container, with fluid passages being formed to extend through the walls of the hermetic container and be connected through pipes to external equipments such as, for example, an evaporator and condenser, when the machine is used in a refrigeration system.

The scroll type compressor section has a compressor which is constituted by a stationary scroll member and an orbiting scroll member mated therewith. These scroll members have spiral wraps formed in conformity with an involute curve or a curve approximating involute curve so as to protrude upright from the end plates. These scroll members are assembled together such that their wraps mesh each other to form therebetween compression chambers the volumes of which are progressively changed in accordance with an orbital movement of the orbiting scroll member. A fluid suction port is communicated with a portion of the stationary scroll member near the radially outer end of the outermost compression chamber, while a fluid discharge port opens in the portion of the stationary scroll member close to the center thereof. An Oldham's ring mechanism is placed between the orbiting scroll member and the frame or between the orbiting scroll member and the stationary scroll member, so as to prevent the orbiting scroll member from rotating about its own axis. The orbiting scroll member is driven by a crankshaft connected thereto so as to make an orbital movement with respect to the stationary scroll member without rotating about its own axis. Consequently, the volumes of the compression chambers mentioned before are progressively decreased to compress the fluid confind in these chambers, and the compressed fluid is discharged from the discharge port as the compression chambers are brought into communication with the discharge port. In order to attain a high compression efficiency in the operation of the scroll-type compressor, therefore, it is quite essential that the orbiting scroll member is pressed to the stationary scroll member at a moderate pressure.

The force for pressing the orbiting scroll member onto the stationary scroll member is derived as the difference between the force produced by the pressure acting on the rear side of the orbiting scroll member and the force produced by the fluid which is being compressed and thus acting on the front or inner side of the orbiting scroll member. The force acting on the rear side of the orbiting scroll member is produced by the fluid pressure which is transmitted from the compression chambers to a back pressure chamber formed on the rear side of the orbiting scroll member, through a small passage bore or bores.

The lubrication of the bearings and sliding parts of the machine including the meshing parts in the compressor section is achieved by a lubricating oil which is drawn up from a well or reservoir formed in the hermetic container. More specifically, the lubricating oil is drawn up through an oil passage bore formed in the crankshaft, is supplied to the bearings by the pressure difference between the intermediate pressure and the high pressure attainable in the compressor, and is then introduced into the back pressure chamber behind the orbiting scroll member. The lubricating oil supplied to the back pressure chamber is discharged into the compression chambers at a moderate rate through the small passage bore and is circulated together with the compressed gas. This scroll-type compressor is shown, for example, in Japanese Patent Laid-open No. 73886/1982.

In order to prevent any reversing of the fluid from the high-pressure side to the low-pressure side during the suspension of operation of the compressor, a discharge valve, disposed in the high-pressure gas discharging passage of the compressor, is adapted to be closed when the compressor stops so that the pressures in the compression chambers are balanced with the low pressure of the suction side. Meanwhile, the lubricating oil also flows out undesirably to the suction side through the passage bore by the pressure difference. Consequently, the amount of the lubricating oil held in the oil well or reservoir in the hermetic container is decreased to such an extent that there is a failure in the supply of the lubricating oil at the time of re-starting of the compressor so as inadequate and to causes troubles such as burning of the bearings and other sliding portions requiring lubrication.

If the discharge valve mentioned before is neglected, the compression chambers are filled with high-pressure gas after stopping of the operation of the compressor, so that the escape of the lubricating oil to the suction side is avoided. In this case, however, the orbiting scroll member is reversed by the difference of the pressure between the discharge side and the suction side, generating a large level of noise.

In the scroll type compressor in which the lubricating oil is supplied by the differential pressure established in a refrigeration cycle, therefore, it is necessary to prevent both the reversing of the orbiting scroll member due to reversing flow of the pressurized fluid and escaping of the lubricating oil to the low-pressure side, during the suspension of operation of the compressor.

In view of the above, it has been proposed to provide a scroll type compressor provided with a check valve disposed in the suction passage leading through the end plate of the stationary scroll member, as disclosed in the specification of U.S. Ser. No. 559,089 entitled "SCROLL-TYPE COMPRESSOR".

It is, however, necessary to further consider a measure for a phenomenon of establishment of local abnormal high pressure in the compression chambers which is accidentally encountered by the above scroll-type machine due to the presence of the suction check valve, otherwise the wrap wall of the orbiting scroll member would be excessively loaded to cause a chance of breakdown of a part of the wrap wall. This phenomenon is serious particularly when the gas has a large liquid content including the liquefied phase of the working fluid and the lubricating oil.

SUMMARY OF THE INVENTION

Accordingly, an object of the invention is to provide a scroll-type fluid machine operable as a compressor, improved to eliminate the reversing of the orbiting scroll member due to reversing flow of the pressurized fluid, as well as the escape of the lubricating oil to the suction side, when the compressor stops to operate, and also to have a safety measure for preventing any abnormal excessive local pressure rise in the compression chamber.

To this end, according to the invention, there is provided a scroll-type fluid machine comprising an orbiting scroll member and a stationary scroll member each having an end plate and a spiral wrap protruding upright from the end plate, the scroll members being assembled together such that their wraps mesh each other to define therebetween closed chambers the volumes of which are progressively decreased as these chambers are moved toward the center of the scroll members as a result of an orbital movement of the orbiting scroll member relative to the stationary scroll member, thereby to continuously drawn and discharge the refrigerant gas, wherein the improvement comprises: a fluid check valve disposed in a refrigerant suction passage for preventing reversing of the orbiting scroll member; a passage for communication between a refrigerant gas suction chamber defined by both scroll members and another chamber; and a pressure relieving means disposed in the communication passage and adapted to relieve any abnormally high pressure established in the suction chamber.

Preferably, the pressure relieving means may comprise a valve device adapted to open and close the communication passage in accordance with the level of the pressure difference between the suction chamber and the other chamber.

The above-mentioned other chamber may preferably be a high-pressure chamber or a chamber the internal pressure of which is intermediate between the suction pressure and the discharge pressure. With such an arrangement, it is easy to communicate such a chamber with the suction chamber, because such a chamber is disposed adjacent to the suction chamber.

The other chamber may be a low-pressure chamber, and, in this case, a higher stability of the valve device operation can be attained if a spring is used to urge a valve in the closing direction.

In a practical form of the invention, the valve device comprises a reed valve which is normally closed by the pressure difference between the discharge chamber and suction chamber. This reed valve can be mounted easily on the open end of a communication passage formed to extend through the stationary scroll member adjacent the discharge chamber.

The valve means may be a reed valve which is normally closed by the pressure difference between one of the closed chambers having an intermediate pressure between the suction pressure and the discharge pressure and the suction chamber. Such a reed valve can be mounted easily on the open end of a communication passage formed to extend through the orbiting scroll member adjacent the compression chamber of the pressure intermediate between the suction pressure and the discharge pressure.

It is also possible to constitute the valve device by a slide valve or a ball valve which is normally closed by the pressure difference between the discharge chamber and suction chamber. These types of valve devices can easily be mounted in a compact manner within the stationary scroll member so as to open and close a communication passage which is formed to extend through the stationary scroll member.

It is also possible to constitute the valve device by a slide valve or a ball valve which is normally closed by the pressure difference between the discharge chamber and suction chamber and by the force of a spring. These valves can easily be mounted in the stationary scroll member in a compact manner so as to open and close without fail a communication passage formed through the stationary scroll member while being assisted by the force of the spring.

BRIEF DESCRIPTION OF THE DRAWINGS

The invention will be described hereinunder with reference to the accompanying drawings in which:

FIGS. 5 to 14 are fragmentary sectional views of different examples of the valve device, wherein:

FIG. 5 is a sectional view of a valve device employing a flat tabular valve member;

FIG. 6 is a plan view of the valve device shown in FIG. 5;

FIG. 7 is a sectional view of a valve device employing a piston-type valve member;

FIG. 8 is a sectional view of a valve device employing a ball-type valve member;

FIG. 9 is a sectional view of a valve device employing a piston-type valve member combined with a spring;

FIG. 10 is a sectional view of a valve device employing a ball-type valve member combined with a spring;

FIG. 11 is a sectional view of a valve device comprising a reed valve attached to the side wall of the stationary scroll member;

FIG. 12 is a sectional view of a valve device having a piston-type valve member combined with a spring and incorporated in the flange portion of the stationary scroll member;

FIG. 13 is a sectional view of a valve device employing a reed valve provided on the portion of the end plate of the orbiting scroll member adjacent to the back pressure chamber; and FIG. 14 is a sectional view of a valve device having a chamber inner wall serving as a stopper for a reed valve.

DESCRIPTION OF THE PREFERRED EMBODIMENTS

Figure 1:
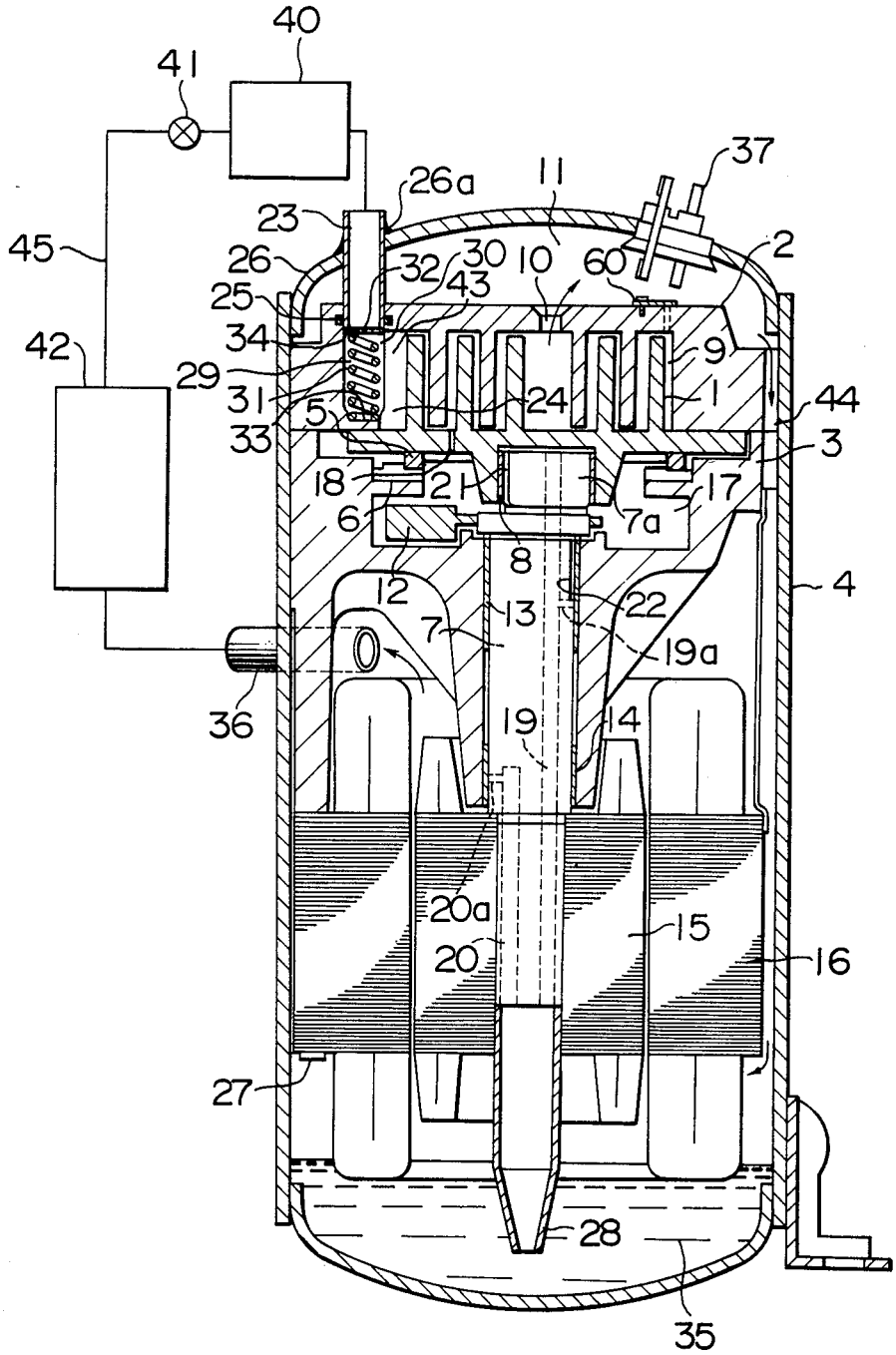
FIG. 1 is a sectional view of a scroll-type compressor.

Referring to the drawings, a scroll-type fluid machine of the invention, which is in this case a compressor of a refrigeration system, has an orbiting scroll member 1 which is constituted by a disc-like end plate and a spiral wrap protruding upright therefrom, and a stationary scroll member 2 having a similar construction and meshing therewith so as to form, in combination with a frame 3, a compressor section of the machine. The compressor section is fixedly received in a cylinder 4 constituting a hermetic container. An Oldham's key 5 is disposed in a back pressure chamber 17 formed behind the orbiting scroll member 1 between the rear face of the orbiting scroll member 1 and the frame 3. The Oldham's keys slidably engages with a groove formed in an Oldham's ring 6. The compressor section further includes a crankshaft 7 having an eccentric shaft portion **7*a* coupled to the orbiting scroll member 1 through an orbiting bearing 8. Closed chambers 9 are defined by the meshing wraps of both scroll members 1 and 2, and the arrangement is such that the closed chambers 9 are brought into communication with a discharge port 10 formed in the central portion of the stationary scroll member 2, while progressively decreasing their volumes, in accordance with the orbital movement of the orbiting scroll member 1**.

The discharge port 10 is communicated with a discharge chamber 11 formed by a cover 26 of the hermetic container. A balance weight 12 is fixed to the crankshaft 7, with the crankshaft 7 being supported by an upper main bearing 13 and a lower main bearing 14.

The scroll-type machine also has a motor section constituted by a motor rotor 15 fixed to the end of the crankshaft 7 and a motor stator 16 fixed to the frame 3 by means of bolts 27. The backpressure chamber 17 is communicated with the closed chambers 9 through passage bores 18 formed through the thickness of the end plate of the orbiting scroll member 1.

An oil passage bore 19 extends through the crankshaft 7 to have one end opened in the lower end 28 of the crankshaft 7 confronting an oil well in the bottom of the hermetic container and the other end opened in the end surface of the eccentric portion **7*a* of the crankshaft 7. An oil passage 19*a* is provided through which the oil passage bore 19 is communicated with an oil groove 22 which is formed in the periphery of the crankshaft 7 at a portion confronting with the bearing 13. Another oil passage bore 20, also formed in the crankshaft 7, opens at its one end in the lower end 28 of the crankshaft 7 and at its other end through an oil passage 20*a* in a portion of the crankshaft 7 embraced by the lower bearing 14. An oil groove 21 is formed in the periphery of the eccentric portion 7*a* along the surface of the orbiting bearing 8**.

The scroll-type fluid machine has a suction pipe 23 which extends through the cover 26 such that one end thereof is connected to an equipment of low-pressure side of the refrigeration system, e.g., an evaporator, while the other end is received in a bore formed through the thickness of the end plate of the stationary scroll member 2. The portion of the suction pipe 23 penetrating the wall of the cover 26 is welded to the wall as at **26*a*, while the other end portion of the same penetrating the end plate is held resiliently by means of a sealing "O" ring 25. The suction pipe 23**, therefore, does not suffer from concentration of stress.

Figure 2:
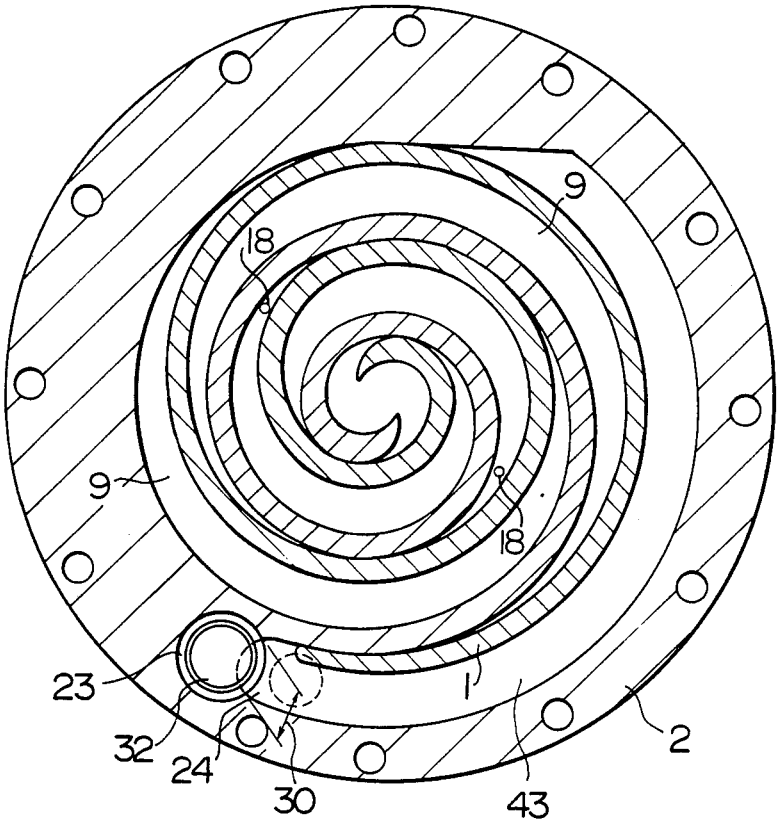
FIG. 2 is a horizontal sectional view showing the state of meshing of two scroll members.

A circular passage 29 is formed in a portion of the stationary scroll member 2 beneath the suction pipe 23 to extend in the axial direction. One side wall of the passage 29 constitutes an opening 30 which opens with a width smaller than the diameter of the passage 29, substantially over the entire range of the wrap height to the arcuate portion of a wrap terminating end portion 24 (FIG. 2) and is communicated with a suction chamber 43. A spring 31 is disposed in the passage 29 so as to be seated at its one end on a bottom 33 of the passage 29 and to press a valve plate 32 upwardly at its other end to constitute a check valve. The seat surface of the valve plate 32 is held in close contact with the lower end surface of the suction pipe 23. The terminating end portion 24 of the stationary scroll member 2 has an arcuate form to facilitate the formation of the opening 30 of the passage 29 mentioned above. Lubricating oil 35 is accumulated in the oil well formed in the bottom of the hermetic container.

The scroll-type machine further has a discharge pipe 36 leading through the wall of the hermetic container to a condenser 42 which, in turn, is connected to the evaporator 40 through a pipe 45 having an expansion valve 41. Thus, the scroll-type fluid machine serving as a compressor is combined with the condenser 42, expansion valve 41 and the evaporator 40 to form a closed refrigeration cycle. A terminal 37 is provided for connecting electric power supply to the fluid machine.

Figure 3:
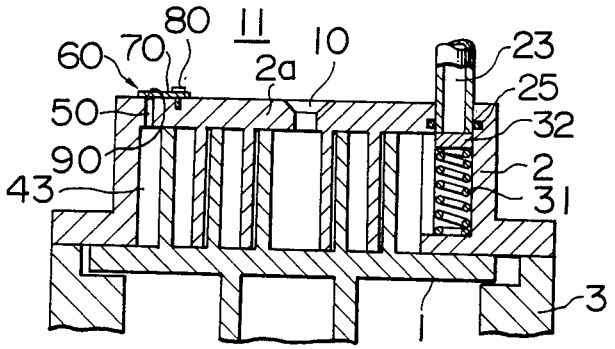
FIG. 3 is a vertical sectional view of an essential part of the compressor shown in FIG. 1, employing a reed valve as a valve device of the compressor.
Figure 4:
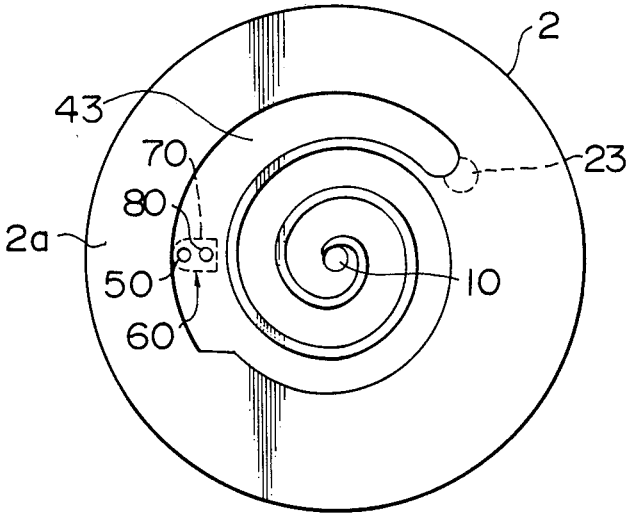
FIG. 4 is a plan view as viewed from the rear side of the stationary scroll member shown in FIG. 3.

Referring to FIGS. 3 and 4, an end plate **2*a* of the stationary scroll member 2 has a passage 50 providing a communication between the suction chamber 43 and the discharge chamber 11, and a valve device 60 adapted for opening and closing the communication passage 50. The aforementioned valve device 60 is composed of a valve member 70 and a screw 80 by means of which the valve member 70 is fixed to the end plate 2*a* of the stationary scroll member 2. Usually, the valve member 70 is pressed onto a seat surface 90 of the passage 50 by the pressure difference between the discharge chamber 11 and the suction chamber 43, thereby blocking the passage 50. However, when the pressure in the suction chamber 43 is raised to an abnormally high level, the valve member 70 is deflected to open the passage 50** thereby relieving the abnormal pressure. This valve device has a simple construction and, therefore, can be mounted easily.

Therefore, in the compressor according to the invention, in the event that the orbiting scroll member 1 is accidentally reversed to cause an abnormal pressure rise in the suction chamber 43, the valve member 70 in the valve device 60 opens the passage 50 thereby relieving the gas from the suction chamber 43 into the discharge chamber 11 through the passage 50, whereby the establishment of an abnormally high pressure in the suction chamber 43 is avoided. Consequently, the undesirable breakdown of the terminating end of the wrap on the orbiting scroll member 1, attributable to the abnormal pressure in the suction chamber, is avoided.

Although a reed valve is used as the valve member constituting the valve device in the described embodiment, this is not exclusive and the valve device may be constituted by other types of valves which will be explained hereinunder with reference to FIGS. 5 to 10.

Figure 5:
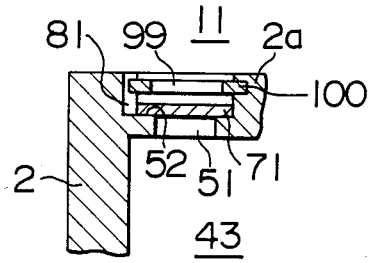
Figure 6:
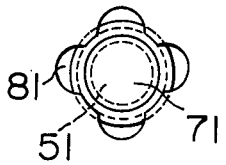

FIGS. 5 and 6 show another example of the valve device in which an opening 81 of a diameter greater than that of the passage 51 is formed in the end plate **2*a* of the stationary scroll member so as to be communicated with the passage 51. This valve device further has a disc-like valve member 71 and a stopper ring 100 formed with a through aperture 99, which are disposed in the opening 81. Usually, the valve member 71 is pressed onto a seat surface 52 of the passage 51 by the difference pressure between the discharge chamber 11 and the suction chamber 43. However, when the pressure in the suction chamber 43 is increased abnormally, the valve member 71 is forcibly raised to relieve the pressure in the suction chamber 43 into the discharge chamber 11 through the passage 51 and the opening 81. According to this arrangement, it is possible to mount the valve device within the thickness of the end plate 2*a* of the stationary scroll member 2**, without requiring any additional mounting space.

Figure 7:
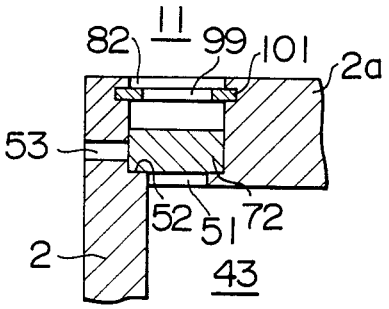

FIG. 7 shows still another example in which the end plate **2*a* of the stationary scroll member 2 has a cylinder portion 82 having a greater diameter than the passage 51 and a passage 53 connected to the passage 51 perpendicularly thereto. A piston-type valve 72 and a stopper ring 101 having the aperture 99 are disposed in the cylinder portion 82. Usually, the valve member 72 is pressed onto the seat surface 52 of the passage 51 by the pressure difference so as to block the passage 51. However, when the pressure in the suction chamber 43 is raised abnormally, the valve member 72 is pushed upwardly to relief the pressure in the suction chamber 43 to the discharge chamber 11 through the passage 51 and the passage 53. In this example, the valve member 72** having a piston-like form can move smoothly without fail.

Figure 8:
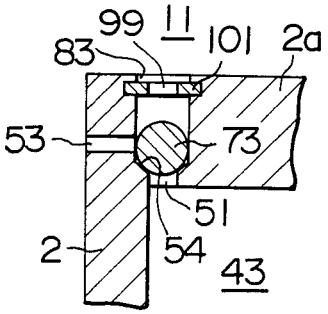

FIG. 8 shows a further example of the valve device in which a ball-type valve member 73 is disposed in a cylinder portion 83 in place of the piston-type valve member shown in FIG. 7. This valve member 73 is usually pressed onto a seat surface 54 by the pressure difference. This arrangement further facilitates the movement of the valve member.

Figure 9:
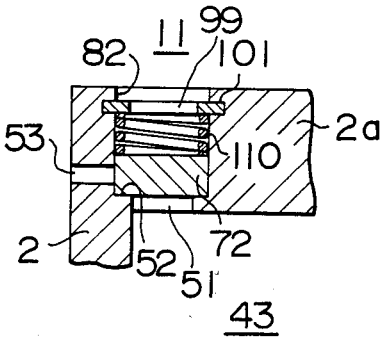

FIG. 9 shows a further example of the valve device which is a modification of that shown in FIG. 7. Namely, in this valve device, a compression spring 110 is loaded to act between the valve member 72 and the stopper ring 101 which are used in the valve device shown in FIG. 7. In this example, therefore, the valve member 72 is pressed onto the seat surface 52 of the passage 51 by the sum of the pressure difference and the force of the compression spring 110.

Figure 10:
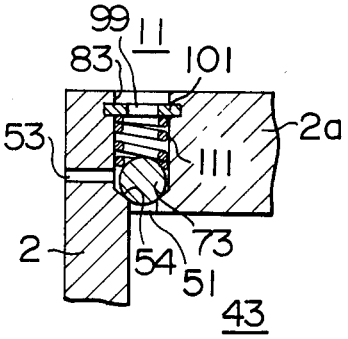

FIG. 10 shows a further example of the valve device which is a modification of the valve device shown in FIG. 8. Namely, in this valve device, a compression spring 111 is loaded between the valve member 73 and the stopper ring 101 which are used in the valve device shown in FIG. 8, so that the valve member 73 is strongly pressed onto the seat surface 54 of the passage 51 by the sum of the pressure difference and the spring force of the compression spring 111.

FIGS. 11 to 14 show examples in which communication passages and valve devices are disposed in other portions than that described hereinbefore.

Figure 11:
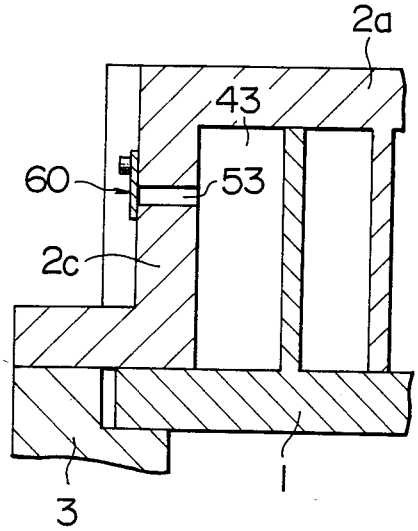

In FIG. 11, the passage 53 and the valve device 60 are provided in a portion of the side wall 2*c* of the stationary scroll member 2 having the suction chamber 43. According to this arrangement, the position of the passage 53 to the suction chamber 43 has a large selection.

Figure 12:
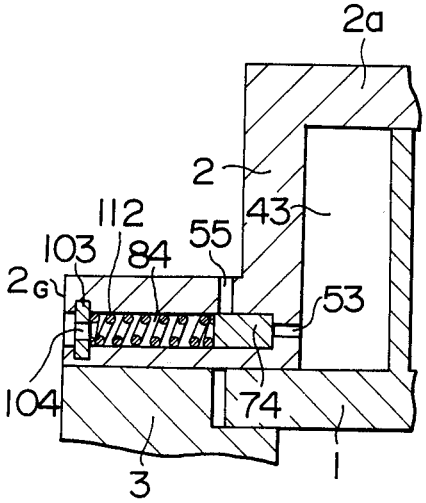

FIG. 12 shows another arrangement in which the passage 53, a passage 55 and a cylinder portion 84 are formed in a flange portion 2G which, in turn, is formed in the lower end of the side wall of the stationary scroll member 2 having the suction chamber 43. The cylinder portion 84 receives a piston-type valve member 74 which is urged by a spring 112 which in turn is retained by a stopper ring 103 having an aperture 104.

According to this arrangement, any liquid phase of the fluid or the lubricant stagnant in the bottom of the suction chamber 43 can be discharged easily because the passage 53 is opened at a low level.

Figure 13:
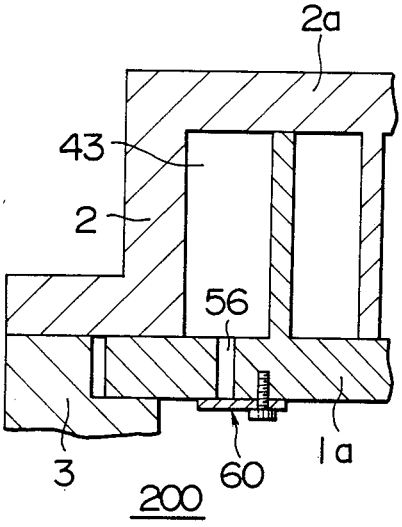

FIG. 13 shows a further example in which a passage 56 and the valve device 60 are formed in a portion of the end plate 1*a* of the orbiting scroll member 1 defining the suction chamber 43. The passage 56 provides a communication between the suction chamber 43 and an intermediate-pressure region behind the orbiting scroll member 1. This arrangement further facilitates the extraction of the liquid phase of the fluid or extraction of the lubricating oil, because the passage 56 is opened downwardly through the end plate 1*a* of the orbiting scroll member.

Figure 14:
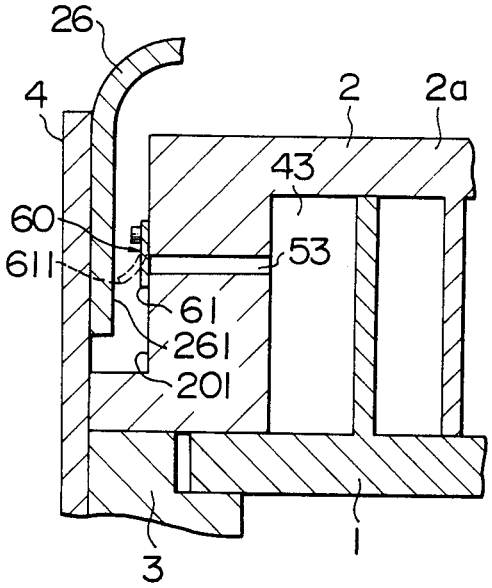

FIG. 14 shows a further example in which the valve device 60 of the reed-valve type is provided on the side wall of the stationary scroll member 2 and the distance between an inner surface 261 of the cover 26 and a side surface 201 of the stationary scroll member 2 is reduced. When a reed valve 61 is opened to the state as shown by broken line, an end 611 of the valve 61 contacts the inner surface 261 of the cover 26 thus permitting the adjustment of opening degree of the valve. That is, the inner surface 261 serves as a stopper for adjusting the degree of opening of the valve.

In the scroll-type fluid machine of the invention, when a spring is used to press the valve member onto the seat surface of the communication passage, it is also possible to arrange such that the passage is opened to the low-pressure side of the machine.

The operation of the scroll-type fluid machine of the invention will be explained hereinunder.

In FIG. 1, the scroll-type fluid machine, used as a compressor, is shown in the suspension of operation. In this state, the valve plate 32 is lifted by the springs 31 to close the suction passage. In this state, the pressure in the suction chamber 43 is equal to or slightly higher than the pressure in the low-pressure side of the refrigeration cycle including the evaporator 40. When the scroll-type compressor is operated in this state, the orbital scroll member 1 is driven by the motor section through the crankshaft 7 and makes an orbital movement with respect to the stationary scroll member 2 so that the gas in the suction chamber 43 is compressed and discharged through the discharge port 10 into the discharge chamber 11. As the gas in the suction chamber 43 is progressively taken away by the successive closed chambers 9, the pressure in the suction chamber 43 is reduced to develop a pressure difference across the valve plate 32 of the check valve. Consequently, the valve plate 32, which has been urged upwardly by the spring 31, is pressed down by the differential pressure overcoming the force of the spring 31 thereby to open the passage. Thus, during the operation, the suction passage is kept opened to a sufficiently large opening degree so that the gas is successively sucked and compressed. The gas of high pressure discharged into the discharge chamber 11 contains the lubricating oil and is introduced into the motor section of the machine through a pssage 44. The motor, which is generating heat and hence maintained at a temperature higher than the gas, is cooled as it is contacted by the gas. At the same time, the oil suspended in the gas is separated as the gas impinges on the wall of the motor section. The lubricating oil thus separated is accumulated in the oil well formed in the bottom of the hermetic container, while the gas now having only a small oil content is forewarded through the discharge pipe 36 to the condenser 42 where it is cooled and liquefied as a result of heat exchange with an external cooling medium such as ambient air. The liquefied fluid is then expanded to a lower pressure through the expansion valve 41 to become a gas of low temperature and pressure and flows into the evaporator 41 where it is evaporated by the latent heat derived from an external medium such as air, thus cooling the air. The gas generated as a result of the evaporation is sucked again into the scroll type compressor through the suction pipe 23 so as to be compressed by the compressor.

Meanwhile, the lubricating oil 35 is supplied from the oil well through the passage bores in the crankshaft 7 by the pressure difference between the high pressure in the closed container and the intermediate pressure existing in the back pressure chamber 17. More specifically, the lubricating oil 35 is supplied from the oil well to the upper and lower bearings 13 and 14, as well as the orbiting bearing 8, through the oil passage bores 19, 20 and the oil passages 19*a*, 20*a*. The lubricating oil after the lubrication is collected in the back pressure chamber 17. The lubricating oil is then introduced to the closed chambers 9 the pressures in which are still lower than that in the back pressure chamber 17, through the passage bore 18, and is compressed and discharged together with the gas.

When the scroll-type fluid machine stops to operate in this state, the compressed gas is not discharged any more but tends to flow back to the low-pressure side of the machine. However, since the pressure in the suction pipe 23 of the low-pressure side is equalized to the pressure in the suction chamber 43 simultaneously with the stopping of the operation, the spring 31 is freed to push up the valve plate 32 thus blocking the suction passage. The balance of pressure between the suction chamber 43 and the suction pipe 23 is attained concurrently with the stopping of operation of the machine, and the blockage of the suction passage by the check valve is made in quite a short time after the stopping of operation of the machine. Consequently, the fluid of high pressure returned into the suction chamber 43, if any, is not allowed to flow back to the low-pressure side of the refrigeration system. Thus, an equilibrium of high pressure is attained in all closed chambers 9 in quite a short period of time, so that the undesirable reversing of the orbiting scroll member does not occur. The amount of the lubricating oil which flows into the closed chambers 9 through the passage bores 18 is so small as to fill the suction chamber 43 which has a small volume. Consequently, the lubricating oil 35 is preserved in the oil well by an amount sufficient for lubricating all parts requiring lubrication after a restarting of the machine.

However, in the case of an accidental reversing of the compressor due to, for example, a connection of electric wires in wrong phase sequence, the gas drawn from the discharge port 10 is forcibly charged into the suction chamber 43. Since the valve plate 32 in the suction chamber 43 in this state serves as a check valve, the internal pressure of the suction chamber 43 is abruptly increased to an abnormally high level by the gas which is forced into this chamber by the reversing of the machine. In response to such an abnormal pressure rise in the suction chamber 43, according to the invention, the valve members 70, 71, 72, 73 or 74 of the valve device 60 is operated to relieve the high-pressure of the gas from the suction chamber 43 into the discharge chamber 11, back pressure chamber 17, or the low pressure side of the system, thus preventing application of excessive load on the wraps of the scroll members.

It will be understood that, if the machine lacks the valve device 60 for relieving excessive pressure, a large pressure difference is developed between the suction chamber 43 and the closed chamber adjacent to the suction chamber, so as to impose a danger of breakdown of the wrap wall separating these chambers due to a too heavy pressure load applied thereto.

As will be understood from the foregoing description, according to the invention, the undesirable reversing flow of the compressed gas is prevented when the compressing operation of the machine is stopped, so that the generation of unpleasant noise is avoided advantageously. In addition, since the escape of the lubricating oil to the low-pressure side is avoided, troubles such as burning of the bearing due to shortage of lubricating oil is avoided after a restarting of the machine.

Furthermore, any abnormal pressure rise in the suction chamber is avoided even if the orbiting scroll member is reversed accidentally, so that the fear of breakdown of the terminating end portions of the wraps of the scroll members is eliminated advantageously.

What is claimed is:

1. A scroll-type fluid machine comprising an orbiting scroll member and a stationary scroll member each having an end plate and a spiral wrap protruding upright from the end plate, said scroll members being assembled together such that the spiral wraps mesh with each other to define therebetween closed chambers, volumes of which progressively decrease as the closed chambers are moved toward a center of the scroll members as a result of an orbiting movement of said orbiting scroll member relative to said stationary scroll member thereby continuously drawing and discharging refrigerant gas, a fluid check valve means disposed in a refrigerant suction passage for preventing reversing of said orbiting scroll members; a passage means for communication between a refrigerant gas suction chamber defined by both scroll members and another chamber; and a pressure relieving means disposed in said communication passage means for relieving any abnormally high pressure established in said suction chamber.

2. A scroll-type fluid machine according to claim 1, wherein said pressure relieving means comprises a valve means adapted to open and close said communication passage means in accordance with a level of a pressure difference between said suction chamber and said another chamber.

3. A scroll-type fluid machine according to claim 1, wherein said another chamber is a high-pressure chamber.

4. A scroll-type fluid machine according to claim 1, wherein said another chamber wherein is a chamber the pressure in is maintained at a pressure intermediate the suction pressure and the discharge pressure of said machine.

5. A scroll-type fluid machine according to claim 1, wherein said another chamber is a low-pressure chamber.

6. A scroll-type fluid machine according to claim 2, wherein said valve means includes a reed valve which is normally closed by the pressure difference between said discharge chamber and said suction chamber and provided on the open end of said communication passage means formed to extend through said stationary scroll member adjacent said discharge chamber.

7. A scroll-type fluid machine according to claim 2, wherein said valve means includes a reed valve which is normally closed by the pressure difference between one of said closed chambers having an intermediate pressure between the suction pressure and the discharge pressure and said suction chamber and provided on the open end of said communication passage means formed to extend through said orbiting scroll member adjacent the chamber of the intermediate pressure.

8. A scroll-type fluid machine according to claim 2, wherein said valve means includes either 1 of a slide valve and a ball valve which is normally closed by the pressure difference between said discharge chamber and said suction chamber and provided in said stationary scroll member so as to open and close said communication passage means which is formed to extend through said stationary scroll member.

9. A scroll-type fluid machine according to claim 2, wherein said valve means includes either one of a slide valve and a ball valve which is normally closed by the pressure difference between said discharge chamber and said suction chamber and by the force of a spring and provided in said stationary scroll member so as to open and close said communication passage means formed through said stationary scroll member.

10. A scroll-type fluid machine according to claim 6, further comprising a container means for housing components of the machine, the inner wall of said container means serving as a stopper means for limiting with a degree of opening of said reed valve.

* * * * *